United States Patent [19]

Zunkel et al.

[11] Patent Number: 4,638,859

[45] Date of Patent: Jan. 27, 1987

[54] GRAVEL PACKER

[75] Inventors: Gary D. Zunkel, Chickasha, Okla.; Michael L. Bolin, Knoxville, Tenn.

[73] Assignee: Halliburton Company, Duncan, Okla.

[21] Appl. No.: 757,040

[22] Filed: Jul. 19, 1985

[51] Int. Cl.[4] ..... F21B 43/04

[52] U.S. Cl. ..... 166/51; 166/126; 166/144; 166/150; 166/152

[58] Field of Search ..... 166/51, 126, 128, 129, 166/131, 138, 144, 150, 152, 377, 386

[56] References Cited

U.S. PATENT DOCUMENTS

| | | | |
|---|---|---|---|
| 3,153,451 | 2/1963 | Chancellor et al. | 166/51 |
| 3,421,586 | 1/1969 | Solum | 166/51 |
| 3,627,046 | 12/1971 | Miller et al. | 166/278 |
| 3,637,010 | 1/1972 | Maly et al. | 166/51 |
| 3,710,862 | 1/1973 | Young et al. | 166/278 |
| 3,726,343 | 4/1973 | Davis, Jr. | 166/278 |
| 3,901,318 | 8/1975 | Fortenberry | 166/278 |
| 3,913,676 | 10/1975 | Barbee, Jr. et al. | 166/278 |
| 3,926,409 | 12/1975 | Abney et al. | 251/344 |
| 3,952,804 | 4/1976 | Smyrl | 166/278 |
| 3,963,076 | 6/1976 | Winslow | 166/278 |
| 3,987,854 | 10/1976 | Callihan et al. | 166/278 |
| 4,044,832 | 8/1977 | Richard et al. | 166/278 |
| 4,049,055 | 9/1977 | Brown | 166/278 |
| 4,105,069 | 8/1978 | Baker | 166/51 |
| 4,192,375 | 3/1980 | Maly et al. | 166/51 |
| 4,273,190 | 6/1981 | Baker et al. | 166/278 |
| 4,295,524 | 10/1981 | Baker et al. | 166/278 |
| 4,296,807 | 10/1981 | Hendrickson et al. | 166/184 |
| 4,418,754 | 12/1983 | Stepp | 166/278 |
| 4,438,815 | 3/1984 | Elson et al. | 166/278 |
| 4,440,218 | 4/1984 | Farley | 166/51 |
| 4,474,239 | 10/1984 | Colomb et al. | 166/278 |
| 4,519,451 | 5/1985 | Gray et al. | 166/386 |
| 4,522,264 | 6/1985 | McNeer | 166/278 |
| 4,570,714 | 2/1986 | Turner et al. | 166/377 |

*Primary Examiner*—Stephen J. Novosad
*Assistant Examiner*—William P. Neuder
*Attorney, Agent, or Firm*—Joseph A. Walkowski

[57] ABSTRACT

The present invention comprises a retrievable gravel packer for circulation and squeeze type gravel packing. The gravel packer includes a compression-set packer element, a J-slot assembly to releasably maintain the gravel packer in an unset mode, a ratchet assembly to releasably lock the gravel packer in a set mode, an intake passage to receive fluid from a tubing string, a return passage to receive fluid from a gravel screen below the gravel packer, a circulation passage extending from the exterior of the gravel packer to intake passage, a closeable crossover assembly to receive fluid from the return passage; a first check valve to prevent back flow back to the intake passage from the interior of the interior of a gravel screen therebelow, a second check valve adapted to selectively open the intake passage to the circulation passage, and a check valve release for removing said second check valve means from the junction of the intake and circulation passages.

20 Claims, 21 Drawing Figures

GRAVEL PACKER

BACKGROUND OF THE INVENTION

This invention relates to a tool for use in gravel packing wells. More specifically, the invention relates to a retrievable gravel packing tool for effecting a circulation-squeeze type gravel pack.

In wells in geological formations where the production of sand from the formation along with the liquids and gases being produced therefrom is a problem, it is well known in the art to install a screen in the production tubing and pack gravel around the screen to prevent the sand from the formation flowing into the production tubing. In such an arrangement, a gravel pack screen assembly is run into the formation on a string of tubing to the desired location and gravel, typically coarse sand mixed in a gelled liquid, is pumped down to the exterior of the gravel pack screen assembly to fill the area between the screen assembly and the formation. After a sufficient amount of gravel has been pumped down to the exterior of the gravel pack screen assembly to completely fill the area between the screen assembly and the formation, the screen assembly is released from the tubing string and the tubing removed from the well with production tubing subsequently being installed in the well.

It is common in the art to circulate the gravel-laden liquid outside the screen assembly, and to return the liquid through the screen to the surface, leaving the gravel in place around the screen assembly. After the initial circulation, the operator may want to further consolidate the gravel pack, which is done through squeezing, or applying pressure to the gravel pack after closing the circulation path used to return the gravel-laden liquid to the surface. It is also desirable to reverse-circulate gravel-laden fluid out of the tubing string and gravel pack screen assembly prior to retrieving it from the wellbore.

SUMMARY OF THE INVENTION

The present invention relates to a weight-set single-zone retrievable gravel packer including a compression-set packer element, J-slot means to releasably maintain the gravel packer in an unset mode, ratchet means to releasably lock the gravel packer in a set mode, an intake passage to receive fluid from a tubing string, a return passage to receive fluid from a gravel screen below the gravel packer, a circulation passage extending from the exterior of the gravel packer to the intake passage, closeable crossover means to receive fluid from the return passage; first check valve means to prevent return flow back to the tubing string through the intake passage, second check valve means adapted to selectively open the intake passage to the circulation passage, and check valve release means for removing said second check valve means from the junction of the intake and circulation passages.

BRIEF DESCRIPTION OF THE DRAWINGS

The present invention will be more readily understood by one of ordinary skill in the art through a review of the following detailed description of the preferred embodiment, taken in conjunction with the accompanying drawings, wherein.

DETAILED DESCRIPTION OF THE PREFERRED EMBODIMENT

Figure 1A:
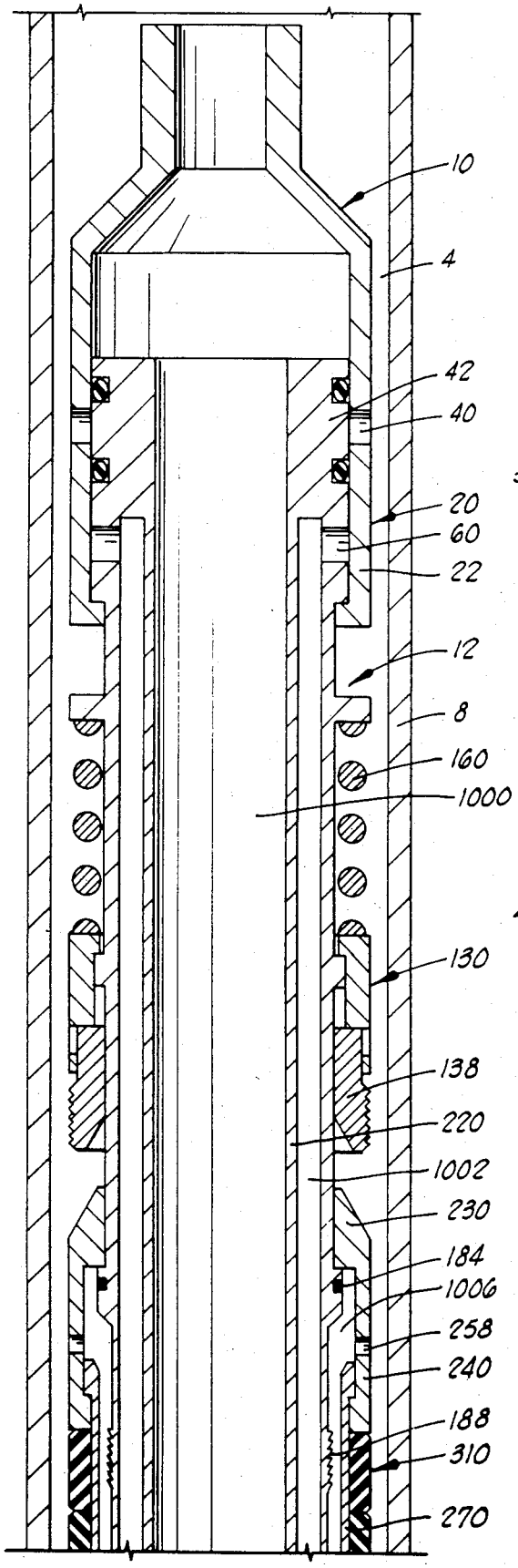
FIGS. 1A–1D comprise a schematic sectional elevation of the gravel packer of the present invention disposed in a wellbore and having a gravel pack screen suspended therefrom via a hydraulic releasing tool.
Figure 1B:
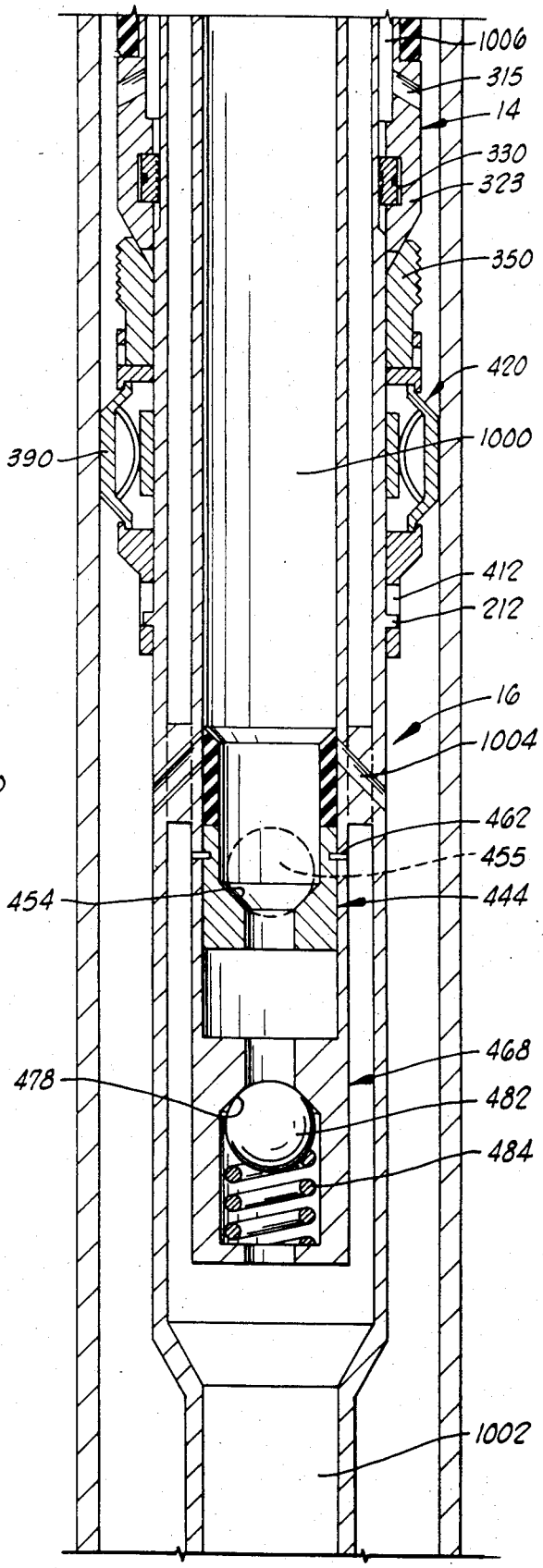
Figure 1C:
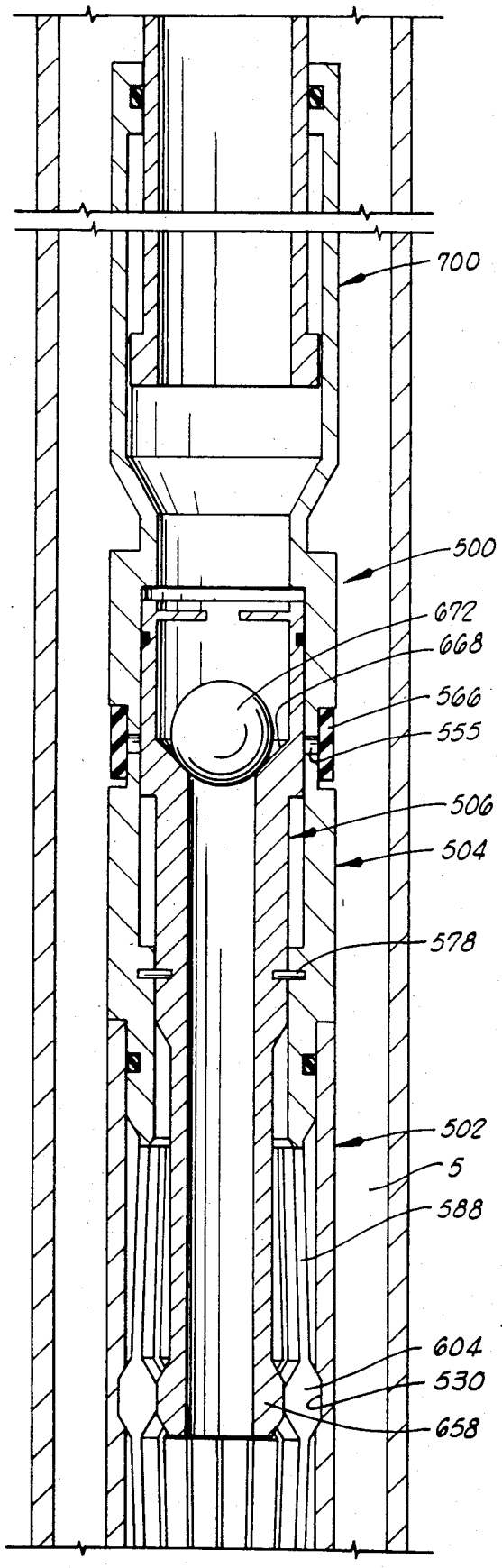
Figure 1D:
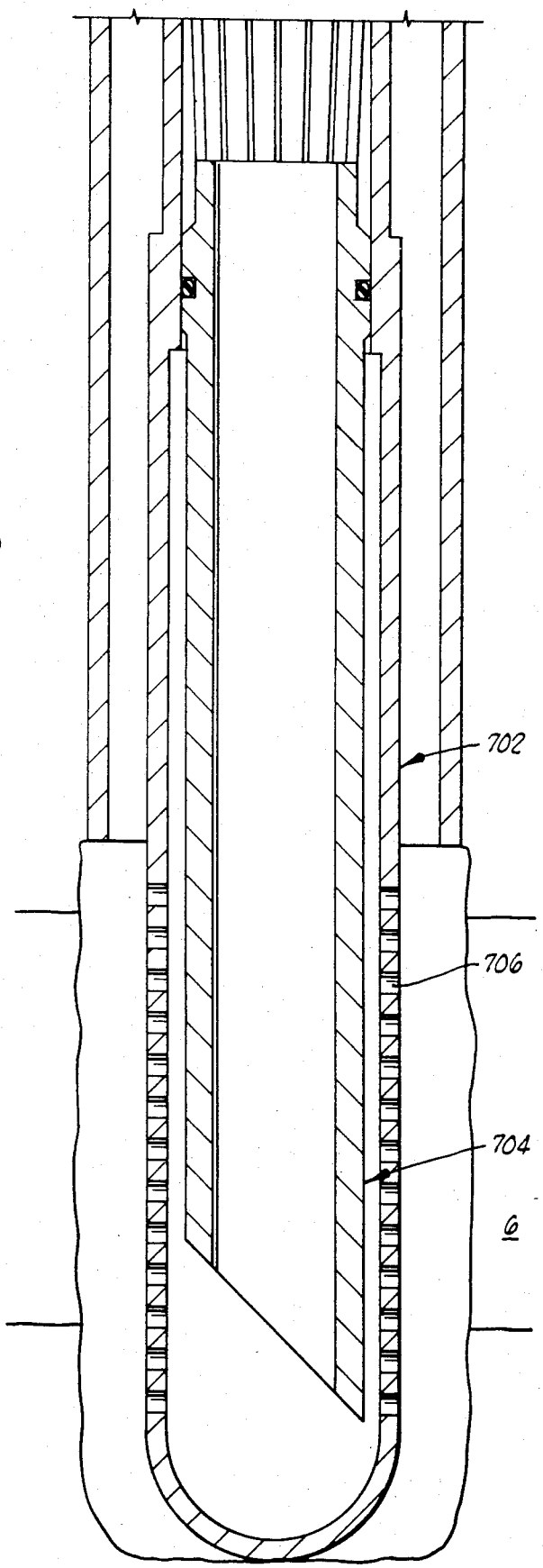

Referring to FIGS. 2A–2H, 3A–3H and 4, gravel packer 10 disposed in wellbore casing or liner 8 comprises mandrel assembly 12 surrounded by housing assembly 14, and having circulation assembly 16 suspended therefrom.

Mandrel assembly 12 includes crossover assembly 20, including tubular crossover housing 22 having threaded adapter bore 24 at its upper end to secure gravel packer 10 to a tubing string (not shown). Crossover housing 22 has a cylindrical exterior 26, and an interior bore 28 below adapter bore 24 including annular shoulder 30, first cylindrical seal bore 32, crossover bore wall 34, second cylindrical seal bore 36, and threaded exit bore 38. A plurality of crossover ports 40 extend through the wall of housing 22 to open on crossover bore wall 34.

Tubular crossover sleeve 42 is slidably disposed in housing 22, upward travel thereof limited by the abutment of annular stop 68 against shoulder 100 on keyway adapter 90. The exterior of crossover sleeve 42 includes first cylindrical seal surface 46 carrying O-ring 48, chamfered annular edge 50 leading to second cylindrical seal surface 52 carrying O-rings 54 and 56 bracketing annular crossover recess 58 to which crossover apertures 60 extend through the wall of sleeve 42, and recessed exterior 62. Stop collar 64 having threaded surface 66 thereon above annular stop 68 is disposed at the bottom of sleeve 42. Housing 22 is made up with sleeve 42 through the engagement of threaded exit bore 38 with threaded surface 66 until the lower edge of housing 22 contacts annular stop 68. The interior of stop collar 64 includes longitudinal, inward-extending keys 80.

The interior of crossover sleeve 42 includes a first seal bore 70 carrying O-ring 72 in the wall thereof, below which crossover bore 74 of greater diameter communicates with crossover apertures 60. Below crossover bore 74, second seal bore 76 of greater diameter and carrying O-ring 77 extends to threaded exit bore 78.

Keyway adapter 90 extends upwardly into sleeve 42, seal surface 92 on the exterior thereof sealing against second seal bore 76, and threaded surface 94 mating with threaded bore 78. Exterior surface 96 having keyways 98 cut therein extends downwardly to annular spring shoulder 100 at the bottom of keyway adapter 90. The interior of keyway adapter comprises a crossover bore 102 of substantially the same diameter as sleeve crossover bore 74, bore 102 extending down to spring shoulder 100, whereat it terminates at a seal bore 104 carrying O-ring 106, below which threaded exit bore 108 leads to the bottom of spring shoulder 100. Keyways 98 accommodate keys 80 of stop collar 64, permitting crossover housing 22 to longitudinally slide or telescope with respect to crossover sleeve 42, while restricting mutual rotation of the two components.

O-ring 106 provides a seal between seal surface 112 on upper mandrel 110 where threaded surface 114 thereon is made up in exit bore 108 of keyway adapter 90. Below threaded surface 114, upper mandrel 110 includes cylindrical exterior surface 116, which includes annular shoulder 118 thereon. At the lower end of surface 116, threaded surface 120 leads to seal surface 122 at the bottom of upper mandrel 110. The bore wall 124 of upper mandrel 110 is of substantially the same diameter as that of crossover bore 102 of keyway adapter 90.

Upper slip assembly 130 is disposed on upper mandrel 110 about shoulder 118. Upper slip collar 132, having annular shoulder 134 on the interior thereof, rides over shoulder 118. Longitudinally extending, circumferentially disposed slots 136 extending to the bottom of slip collar 132 accommodate slips 138 therein, laterally extending legs (not shown) at the upper ends of slips 138 residing in lateral channels 140 of slots 136. Slips 138 have arcuate inner surfaces 142, leading to oblique bottom surfaces 144, while the exterior of slips 138 includes a longitudinal slot 146 bounded by slip walls 148 having teeth 150 thereon. Leaf springs 152 contacting the bottoms 154 of slots 146, and anchored by bolts 156 in spring slots 158 of slip collar 132, maintain slips 138 against exterior surface 116 of upper mandrel 110.

Figure 2A:
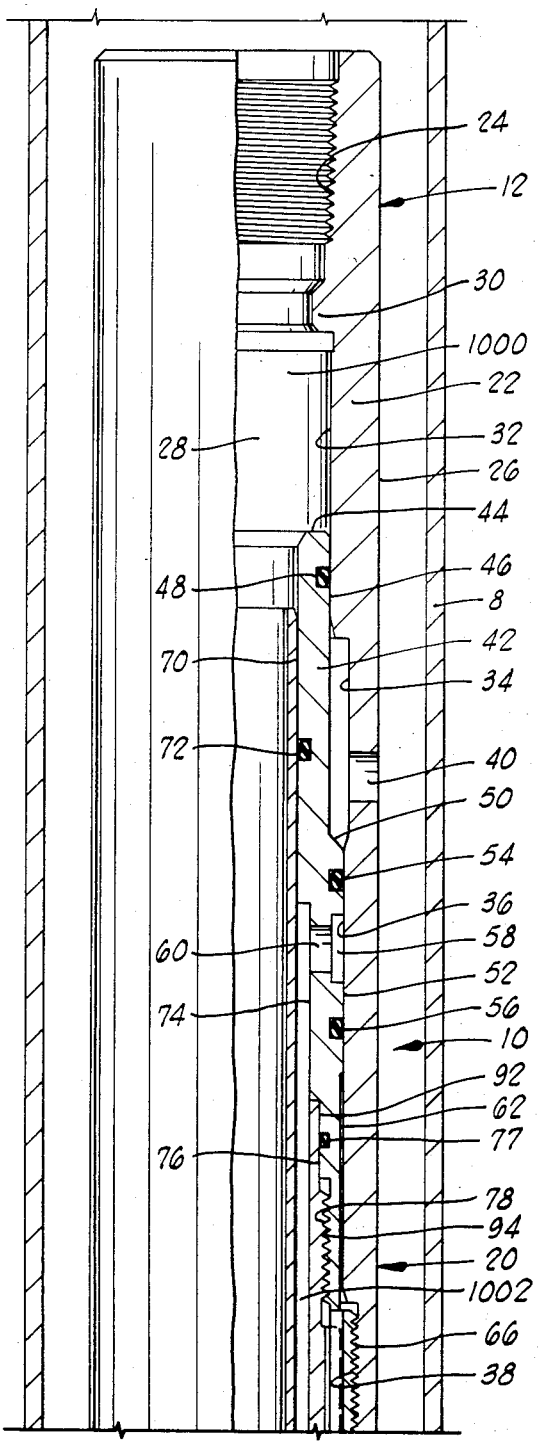
FIGS. 2A–2H comprise a detailed half-section elevation of the gravel packer of the present invention in an unset mode.
Figure 2B:
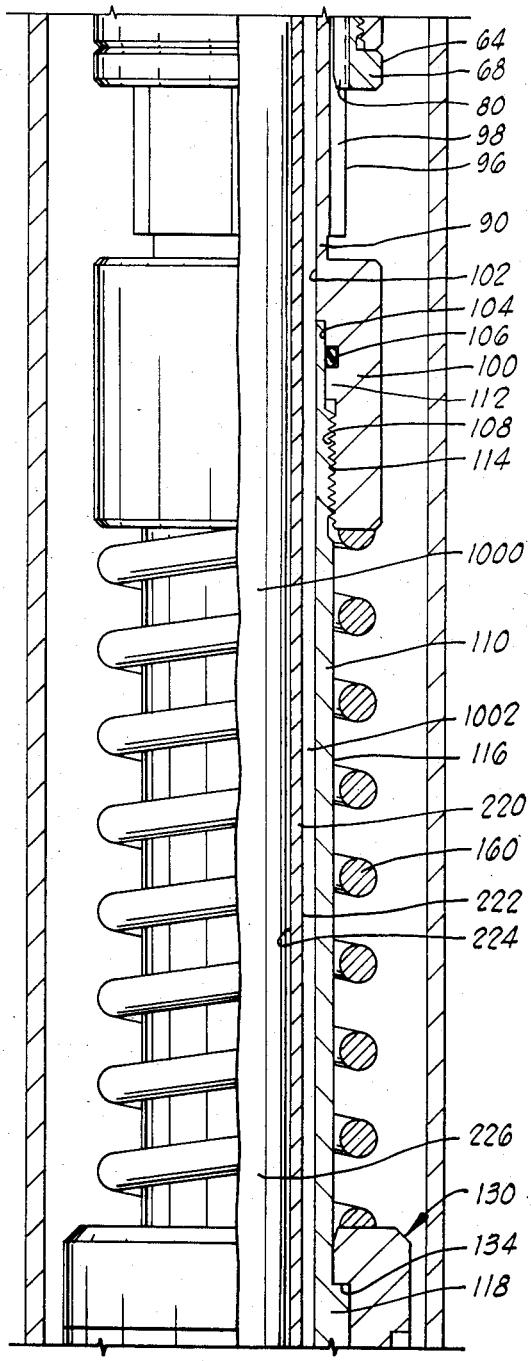
Figure 2C:
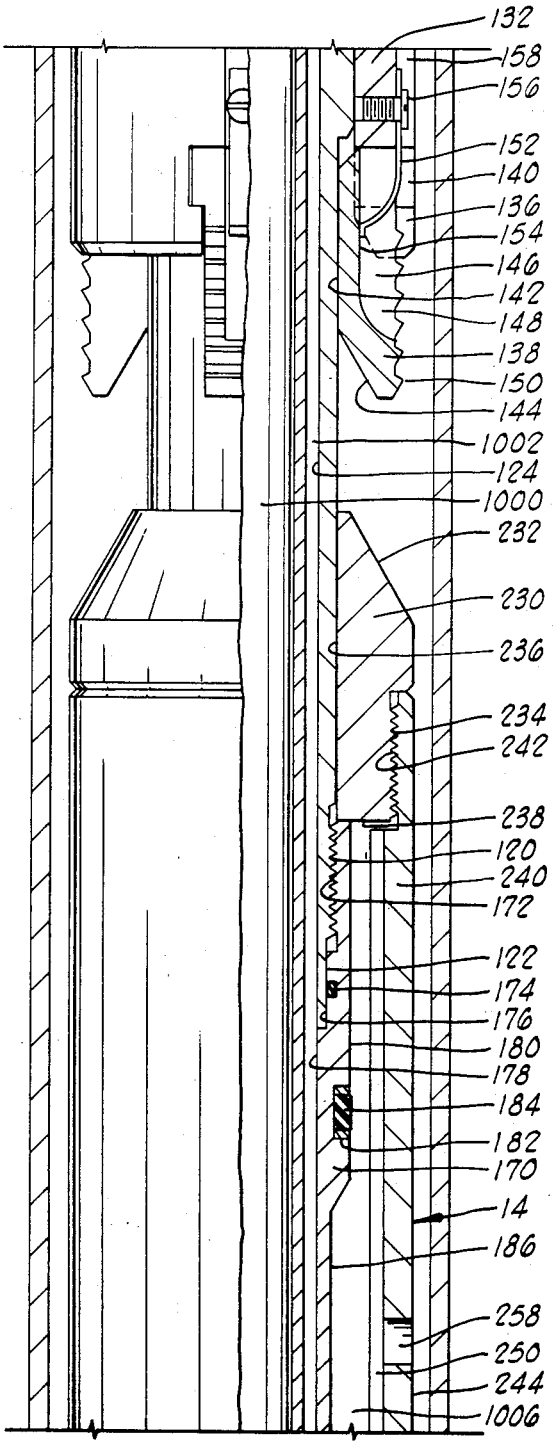
Figure 2D:
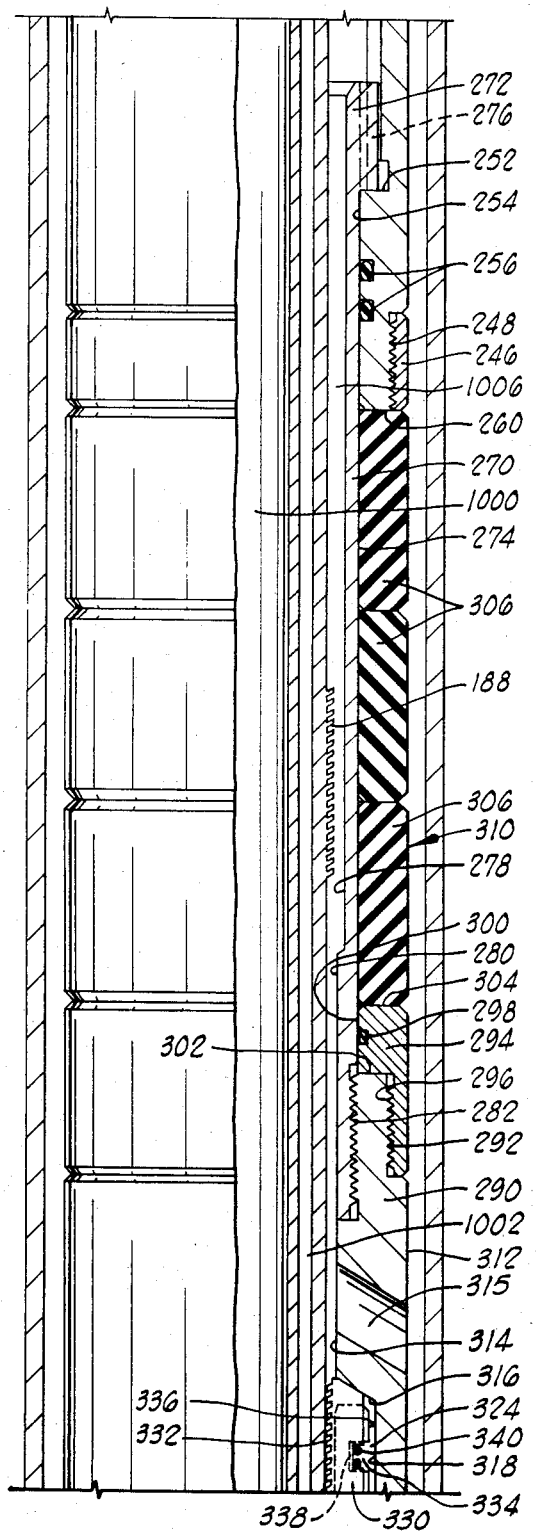
Figure 2E:
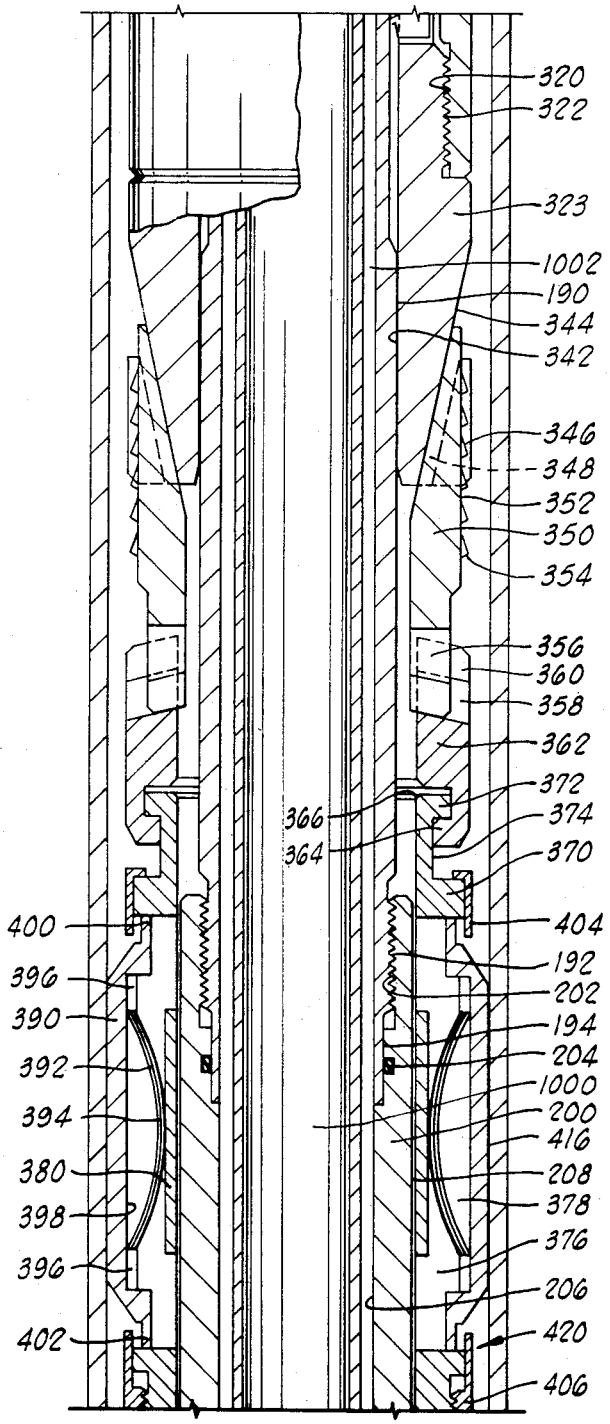
Figure 2F:
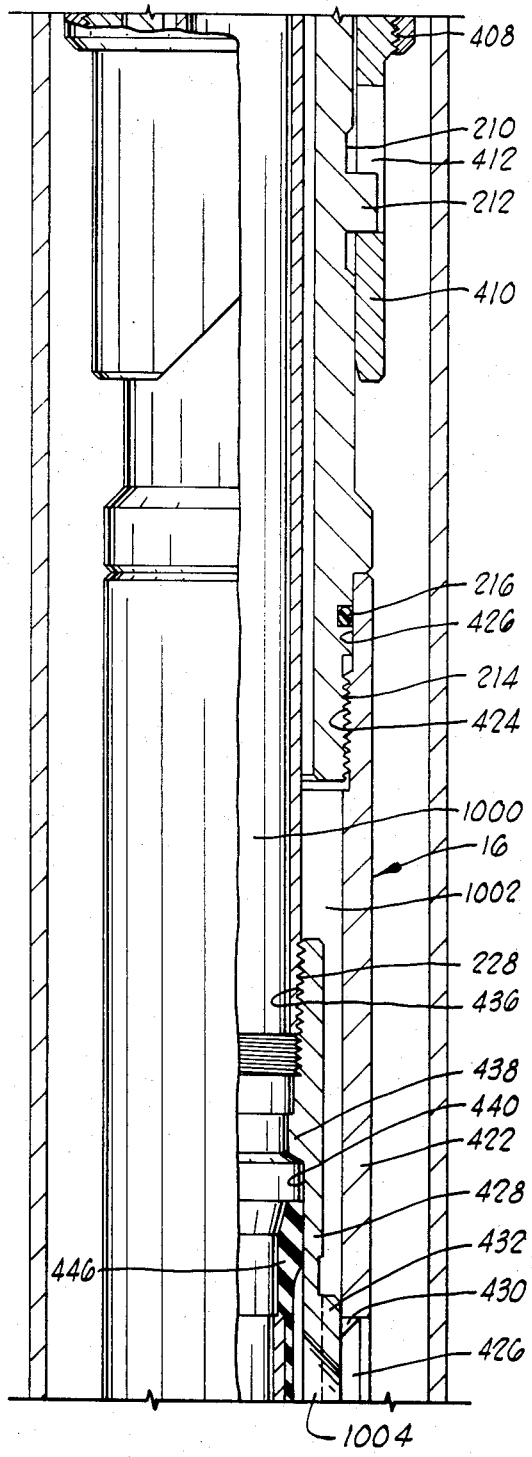
Figure 2G:
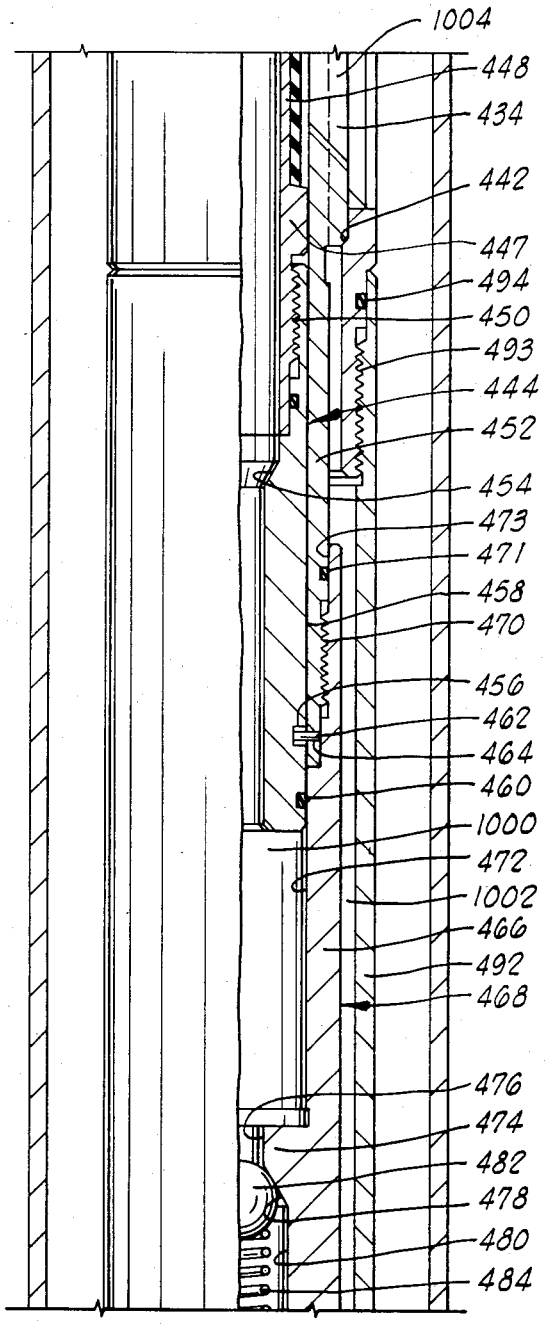
Figure 2H:
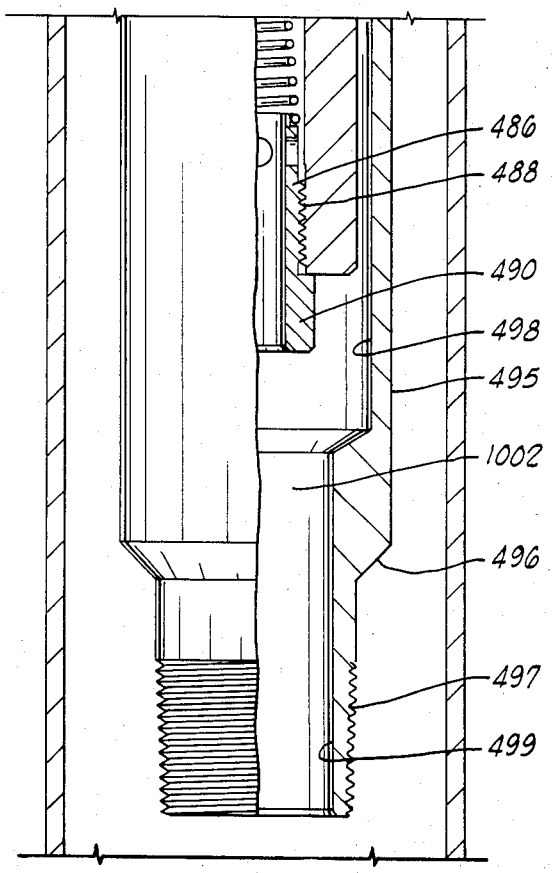

Coil spring 160, surrounding upper mandrel 110, bears against the bottom of keyway adapter 90 and the top of slip collar 132 in a substantially relaxed state in FIG. 2B.

Bypass seal mandrel 170, having threaded entry bore 172 at the top interior thereof is sealed with seal surface 122 on upper mandrel 110 by O-ring 174 when made up therewith. The interior of bypass seal mandrel 170 below seal cavity 176, comprises bore wall 178 of substantially the same diameter as that of upper mandrel bore wall 124. At the upper exterior of bypass seal mandrel 170, seal saddle 180 including shallow annular groove 182 therein accommodates bypass seal 184. Below saddle 180, the exterior of bypass mandrel 170 necks down to cylindrical ratchet surface 186 having lefthand ratchet threads 188 extending outwardly therefrom. At the bottom of bypass seal mandrel 170, enlarged exterior cylindrical surface 190 leads to threaded surface 192 and seal surface 194.

J-slot mandrel 200 is secured to threaded surface 192 via threaded entry bore 202, O-ring 204 therebelow providing a seal with bypass seal mandrel 170 against seal surface 194 thereof. The interior of J-slot mandrel 200 comprises bore wall 206, of substantially the same diameter as bore wall 178. The exterior of J-slot mandrel 200 includes cylindrical surface 208 having recessed area 210 cut therein, from which J-slot lugs 212 radially protrude. The bottom of J-slot mandrel 200 terminates with exterior threads 214, by which circulation assembly 16 is secured thereto, O-ring 216 sealing therebetween.

Tubular intake mandrel 220, having a uniform cylindrical exterior surface 222 and a uniform cylindrical inner bore wall 224 defining slurry intake bore 226, extends from seal bore 70 of sleeve 42 through all of mandrel assembly 12 to connect to circulation assembly 16 via exterior threads 228.

Crossover assembly 20, upper mandrel 110, bypass seal mandrel 170, J-slot mandrel 200, upper slip assembly 130, coil spring 160 and intake mandrel 220 comprise mandrel assembly 12.

Housing assembly 14 includes upper slip wedge collar 230, having frusto-conical slip ramp 232 at the top thereof, threaded cylindrical surface 234 therebelow on the exterior, and an axial bore defined by bore wall 236 extending therethrough, through which upper mandrel 110 is slidably disposed, lower lip 238 on slip wedge collar 230 abutting the top of bypass seal mandrel 170.

Upper bypass case 240 is secured to collar 230 by threaded entry bore 242 mating with threaded surface 234. Exterior cylindrical surface 244 extends downward to packer compression ring 246, which surrounds the lower end of upper bypass case 240 and is joined thereto at threaded junction 248. The interior of upper bypass case 240 includes longitudinally extending splines 250, which extend substantially to radial shoulder 252, below which the interior necks down to seal bore 254, having O-rings 256 disposed in recesses therein. Bypass ports 258 extend through the wall of case 240, and the lower ends of case 240 and co-extensive packer compression ring 246 provide radially flat upper packer compression shoulder 260.

Tubular packer saddle 270 extends through seal bore 254 of case 240, the upper annular end 272 of saddle 270 being of larger diameter than cylindrical packer element surface 274 and containing longitudinal slots 276 therein which slidably mate with splines 250 on the interior of case 240. The upper interior of saddle 270 is undercut to provide an enlarged ratchet bore 278 to clear ratchet threads 188, and a seal surface against which seal 184 may act when gravel packer 10 is set. The lower interior of saddle 270 necks down to exit bore 280.

Saddle 270 is secured at threaded junction 282 to lower bypass case 290, case 290 having threads 292 on its upper exterior by which lower packer compression ring 294 is secured via threads 296. An O-ring 298 carried in seal bore 300 of ring 294 seals against packer element surface 274 of saddle 270. Lower packer compression ring 294 extending over the upper face 302 of lower bypass case 290 provides a radially flat lower packer compression shoulder 304. Three annular elastomeric packer elements 306 comprise packer element means 310 and are disposed about packer saddle 270.

The exterior 312 of lower bypass case 290 is substantially cylindrical while the middle bore 314 thereof below threaded junction 282 is cylindrical and of substantially the same diameter as exit bore 280 of saddle 270, lower bypass ports 315 extending through the wall of case 290 into middle bore 314. Below middle bore 314, chamfered surface 316 leads obliquely outward to ratchet dog bore wall 318, below which threaded exit bore 320 is secured to threaded surface 322 on the upper exterior of lower slip wedge collar 323. Ratchet dog annulus 324, defined between lower bypass case 290, lower slip wedge collar 323 and bypass seal mandrel 170, contains a plurality of arcuate ratchet dogs 330 having left-hand threads 332 cut on the interior thereof, and circumferentially extending slots 334 on the exterior thereof. Spacer legs 336 extending upwardly from lower slip wedge collar 323 separate ratchet dogs 330, legs 336 also containing slot 338 therein aligned with slots 334 on dogs 330. Garter springs or elastic bands 340 extend through slots 334 and 338 about ratchet dogs 330 and spacer legs 336.

The bore 342 of collar 323 is substantially the same as that of middle bore 314 of lower bypass case 290. The lower exterior of collar 323 comprises slip ramps 344 separated by spacer walls 346 having undercut therein lateral channels 348 adjacent the surface of ramps 344. Lower slips 350 ride on ramps 344, lateral webs (not shown) extending into channels 348 in walls 346. The upper exterior of slips 350 comprises slip face 352 having teeth 354 thereon. The lower exterior of slips 350 comprises T-shaped strut 356, the laterally oriented ends of which extend into grooves 358 in the sides of strut channels 360 at the upper end of lower slip collar 362, which is comprised of a plurality of arcuate sections secured together by means well known in the art to form a collar.

Drag block assembly 420 includes drag block housing 370 which interlocks via outwardly facing annular shoulder 372 and recess 374 with inwardly facing shoulder 364 and recess 366 on lower slip collar 362 as the arcuate segments forming slip collar 362 are secured together. Drag block housing 370 contains a plurality of drag block cavities 376 therein, separated by walls 378, arcuate spring bases 380 extending therebetween about J-slot mandrel 200. Drag blocks 390 are disposed in cavities 376 over leaf springs 392, the centers 394 of which bear against spring bases 380, and the ends 396 of which bear against drag blocks 390 in spring cavities 398. Lips 400 and 402 at each end of drag blocks 390 extend longitudinally therefrom, retainer ring 404 maintaining top lips 400 inside cavities 376, and retainer collar 406, which is secured at threaded junction 408 to drag block housing 370, maintains lower lips 402 in cavities 376. The exteriors 416 of drag blocks 390 bear against the walls of casing 8, and may have carbide inserts (not shown) embedded therein to reduce wear.

Figure 4:
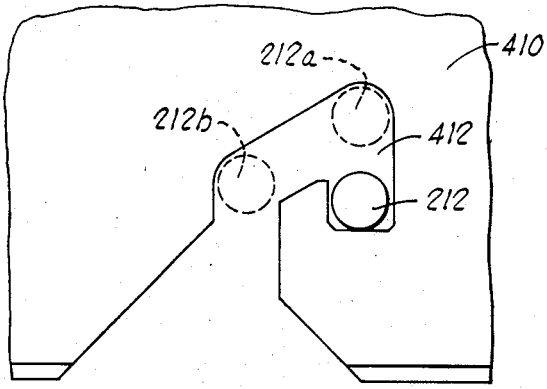
FIG. 4 comprises a development of the J-slot employed in the gravel packer of the present invention.

The lower end of drag block housing 370 comprises J-slot case 410, including J-slots 412 therein, which receive J-slot lugs 212 (see FIG. 4).

Circulation assembly 16 includes tubular circulation housing 422, which is secured via threaded bore 424 to threaded surface 214 on J-slot mandrel 200, seal bore 426 effecting a seal with O-ring 216. The exterior of circulation housing 422 is cylindrical, and circulation ports 426 extending through the wall thereof. Tubular circulation mandrel 428 is disposed within housing 422, and secured thereto by welds 430 between the periphery of circulation ports 426 and the outer surface of lateral protrusions 432 on mandrel 428, which protrusions 428 accommodate lateral circulation channels 434 extending between the interior of circulation mandrel 428 and the exterior of protrusions 432, which are aligned with circulation ports 426. Circulation mandrel is secured to intake mandrel threads 228 via threaded bore 436, below which annular shoulder protrudes 438 inwardly above smooth check valve bore 440, extending to the bottom of mandrel 428. Protrusions 432 rest on annular lip 442 on the interior of circulation housing 422 in addition to being welded at 430. Check valve assembly 444 is slidably disposed within check valve bore 440 of mandrel 428, and comprises elastomeric sleeve 446 bonded above shoulder 447 to tubular body 448, which is secured at threaded junction 450 to valve seat body 452, body 452 including frusto-conical ball seat 454 in the bore thereof, and shear pin recess 456 in its exterior surface 458, below which is carried O-ring 460. A plurality of shear pins 462 extend into shear pin recess 456 from shear pin apertures 464 in the wall of circulation mandrel 428, maintained therein by cylindrical housing 466 of spring check assembly 468, which is secured to the lower end of mandrel 428 at threaded junction 470, O-ring 471 on the exterior of mandrel 428 effecting a seal with seal bore 473 above junction 470 on housing 466. Check valve assembly 444 extends slightly into the upper bore 472 of housing 466, O-ring 460 slidably sealing thereagainst. Annular shoulder 474 in housing 466 defines constricted bore 476 above frusto-conical valve seal 478 at the top of spring check bore 480, check ball 482 being biased against seat 478 by coil spring 484, which is supported by tubular spring base 486 threaded to the interior of housing 466 at junction 488, until flange 490 abuts the bottom of housing 466.

Lower adapter 492 is secured to circulation housing 422 at threaded junction 493, O-ring 494 sealing therebetween. Cylindrical exterior surface 495 necks down at 496 to exterior threads 497, while interior bore wall 498 necks down below spring check assembly 468 to exit bore 499.

Various passages are defined within gravel packer 10. Central intake passage 1000 extends from the top of gravel packer 10 through check valve assembly 444 to spring check assembly 468. Return passage 1002 extends from the bottom of gravel packer 10 below spring valve assembly 468, becomes annular in shape thereat and continues upward around circulation mandrel 428 (past protrusions 432), around intake mandrel 220 upward to crossover assembly 20, ending at crossover apertures 60. Circulation passages 1004 extend from the interior of circulation mandrel 428 to the exterior of gravel packer 20 at circulation housing 422.

Concentric bypass passage 1006 extends from upper bypass ports 258 through annular channel defined between upper bypass case 240, packer saddle 270, lower bypass case 290 and bypass mandrel 170, to lower bypass ports 315.

OPERATION OF THE PREFERRED EMBODIMENT

Referring generally to FIGS. 1A–1D, 2A–2H, 3A–3H and 4 and more specifically to FIGS. 1A–1D, gravel packer 10 suspended from a tubing string (not shown) is schematically depicted in wellbore casing or liner 8, an hydraulic releasing tool 500 disposed below gravel packer 10 through slip joint 700 and a gravel screen 702 suspended from hydraulic releasing tool 500 below blank pipe. Gravel screens and slip joints are well known in the art, and hydraulic releasing tool 500 may be as more fully described in co-pending U.S. patent application Ser. No. 756,040, filed on even date herewith and assigned to Halliburton Company. A washpipe or tailpipe 704 is suspended from hydraulic releasing tool 500 and extends into screen 702, which extends across producing formation 6. As the tubing string is run into the wellbore, fluid can move around packer element means 310 via bypass passage 1006, and the tubing string is filled through circulation passages 1004 and intake passage 1000, due to inward deflection of sleeve 446 in response to the wellbore/tubing string pressure differential.

After running the tubing string into the wellbore, the bottom of the wellbore is tagged with gravel screen 702 and slip joint 700 is compressed. The string is then picked up to extend the slip joint 700 while leaving the screen on bottom.

Gravel packer 10 is then set by application of right-hand rotation through mandrel assembly 12, which moves J-slot lugs 212 to positions **212*b* (see FIG. 4) above the open bottoms of J-slots 412 from 212*a*, from which they were removed when the tubing string was picked up. The tubing string is then set down, which sets lower slips 350 against lower slip wedge collar 323**

Figure 3A:
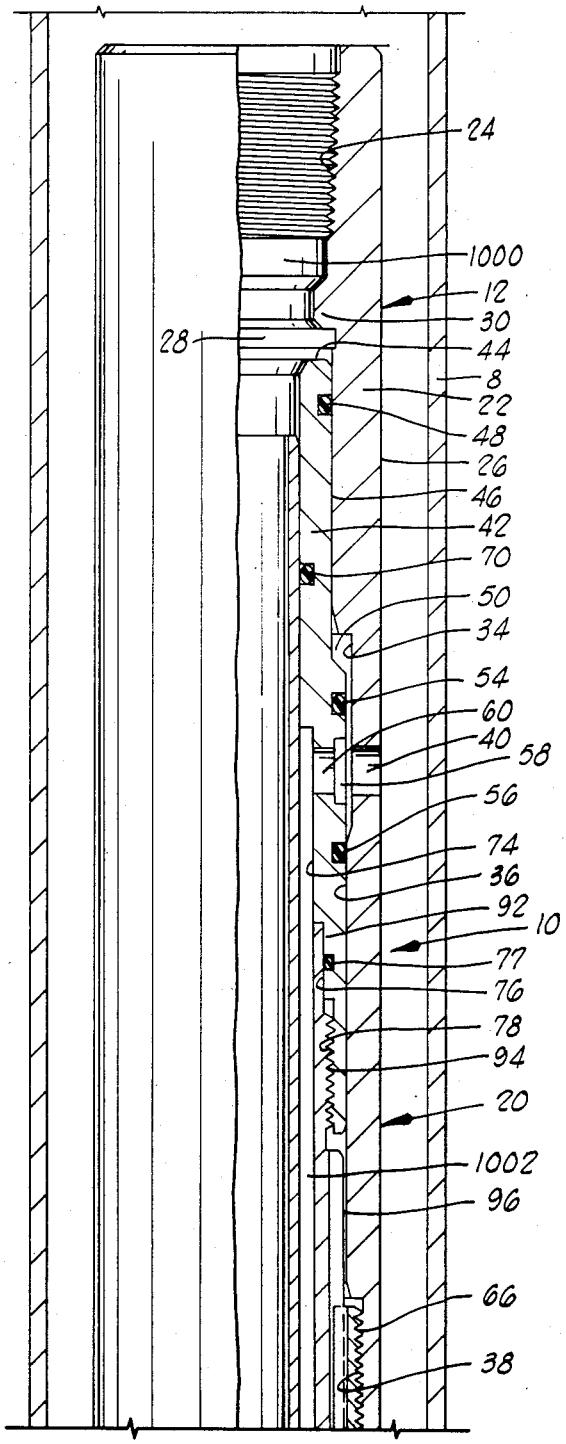
FIGS. 3A–3H comprise a detailed half-section elevation of the gravel packer of the present invention in a set mode.
Figure 3B:
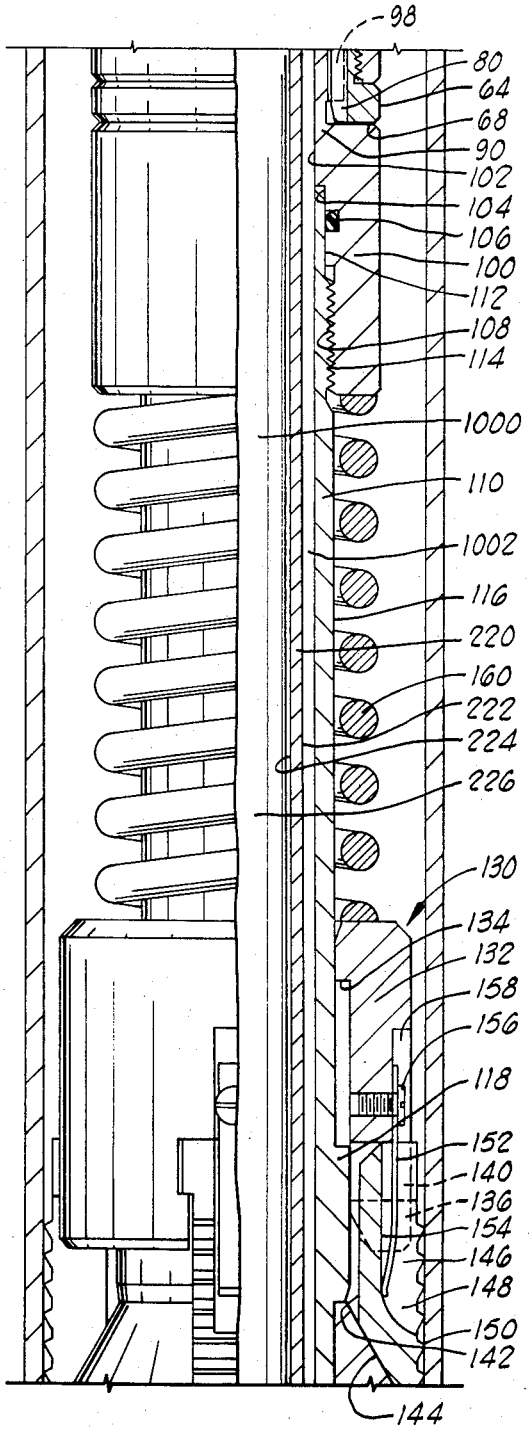
Figure 3C:
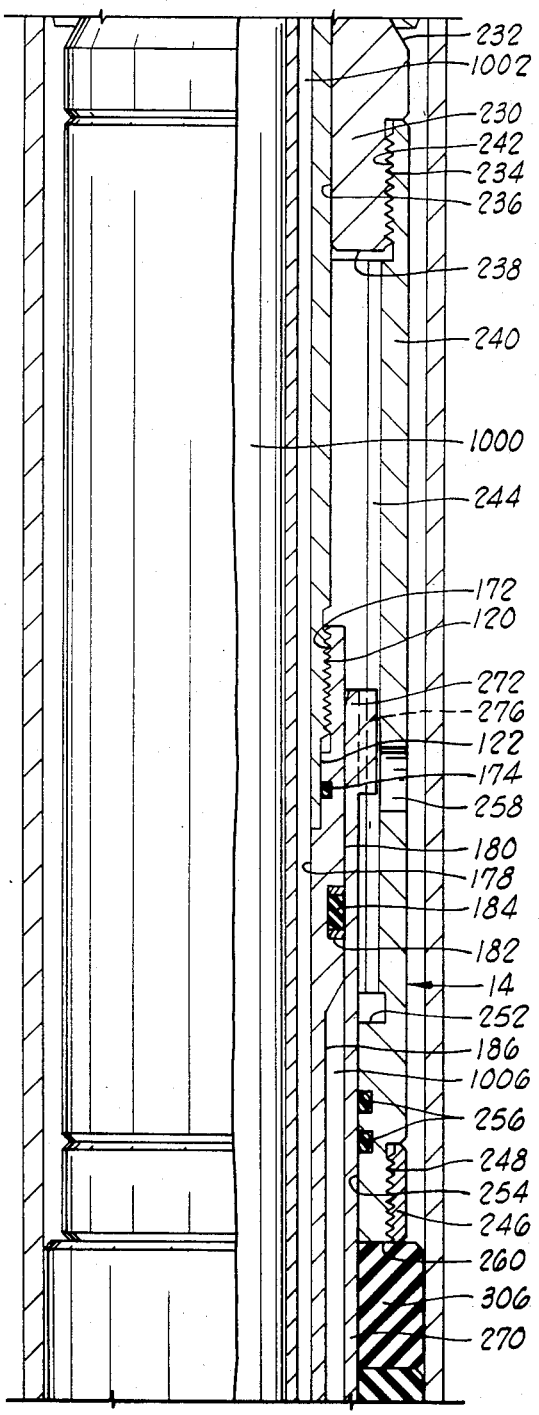
Figure 3D:
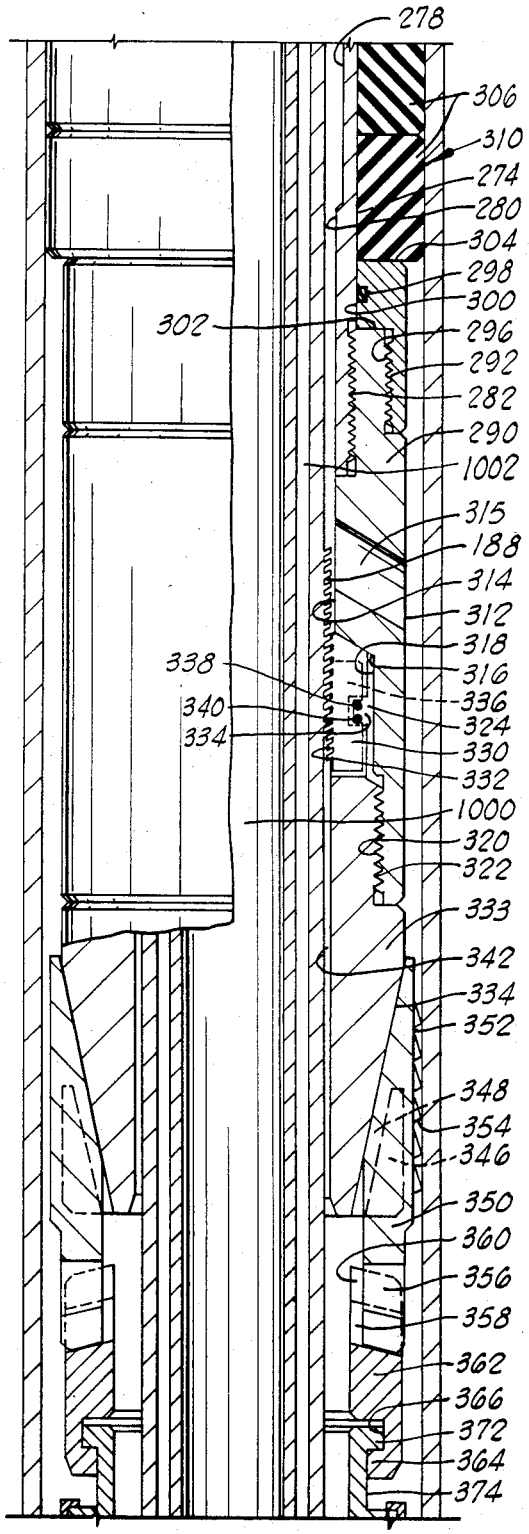
Figure 3E:
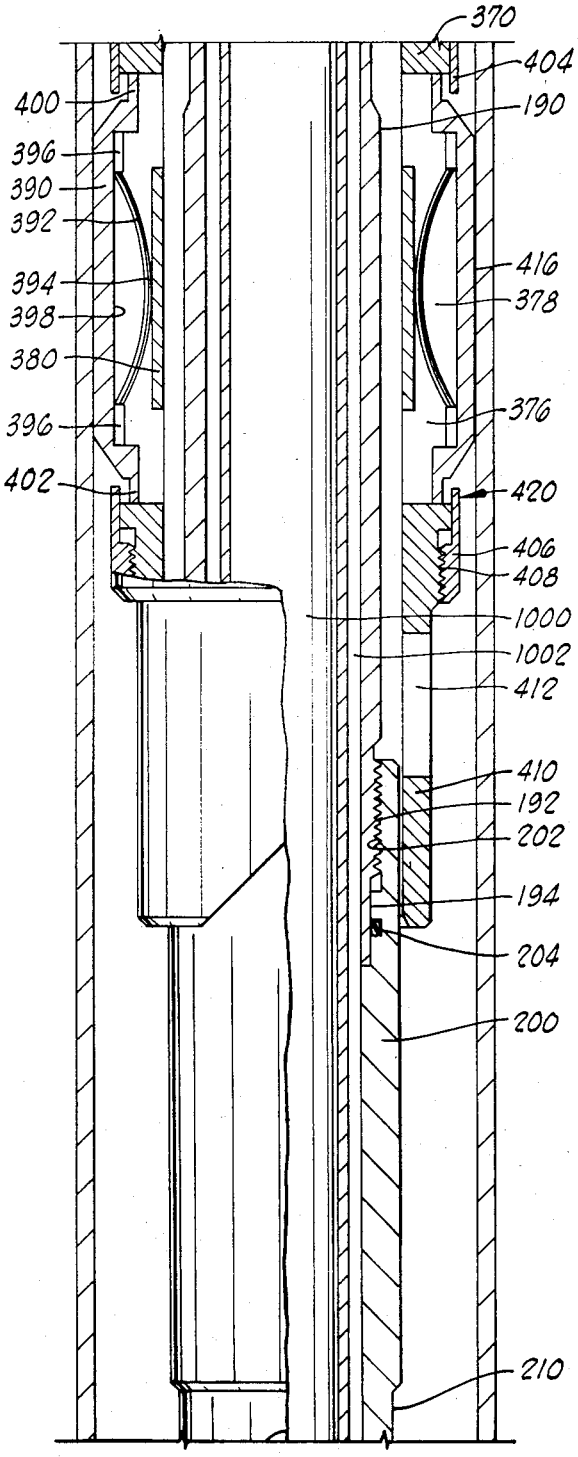
Figure 3F:
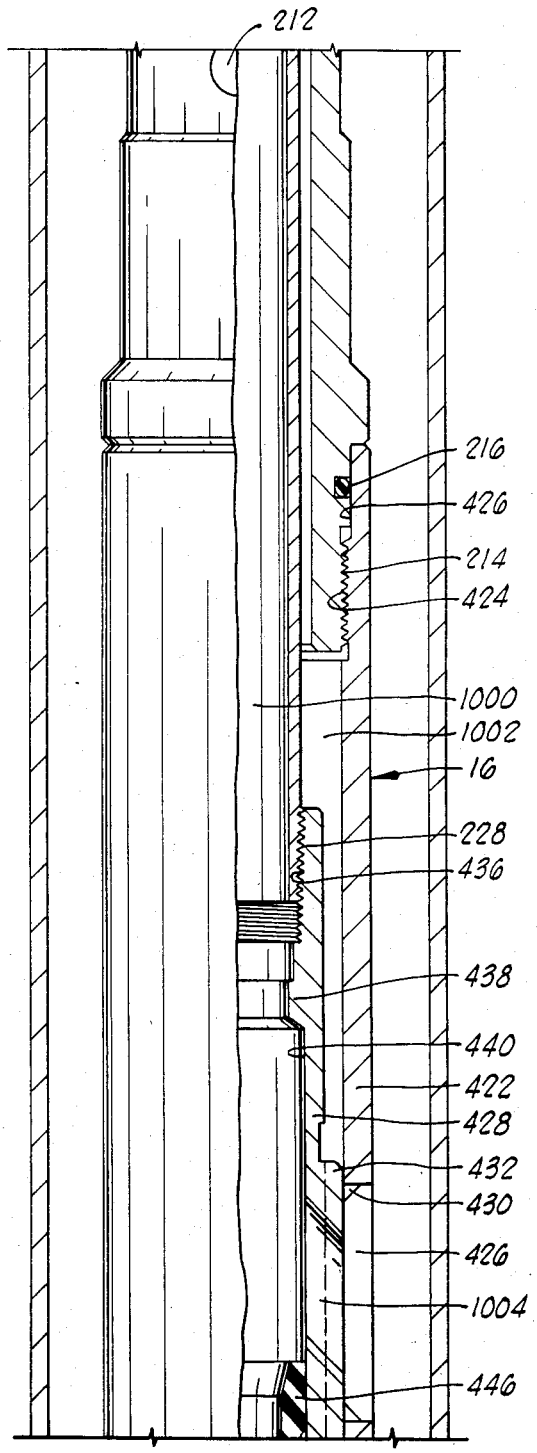
Figure 3G:
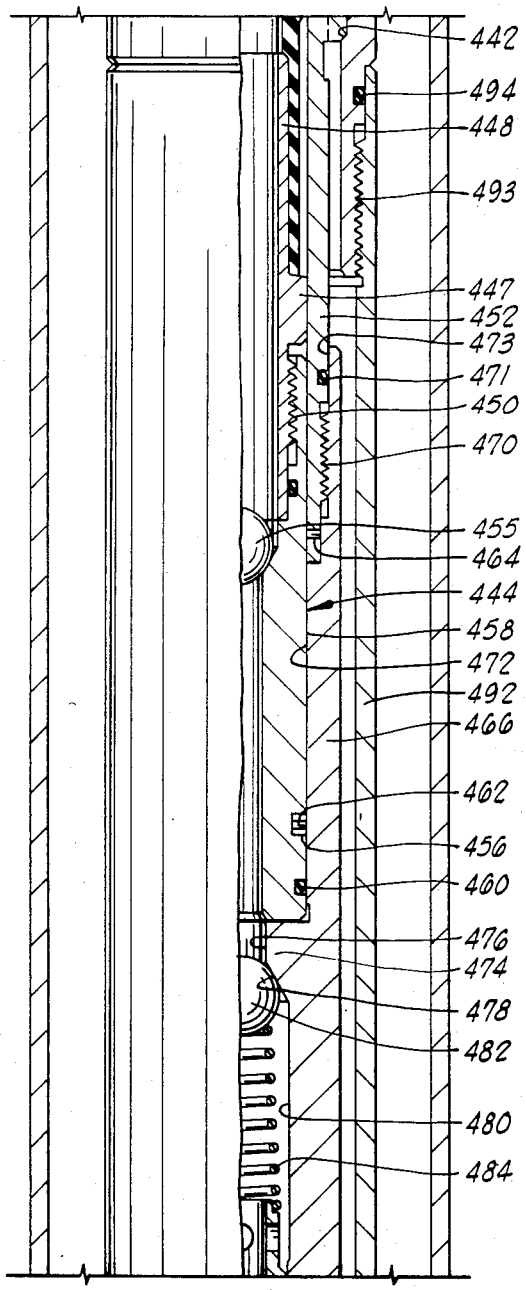
Figure 3H:
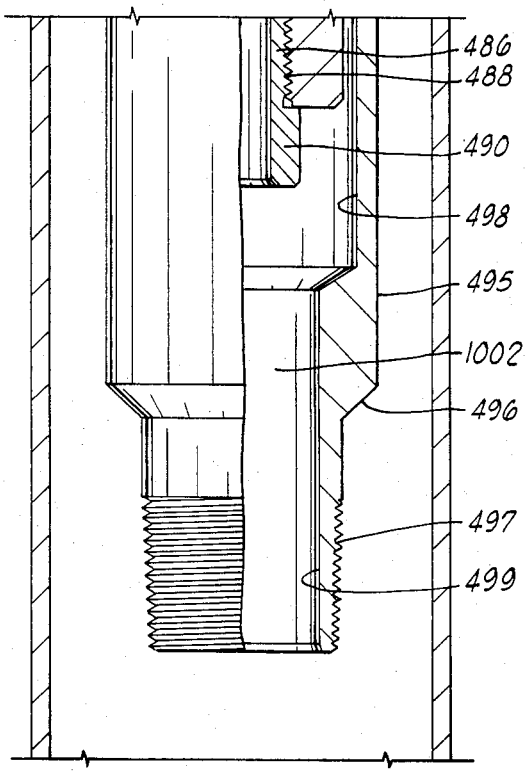

(FIG. 3D) through movement of mandrel assembly 12 with respect to housing assembly 14, the latter's movement being restricted by drag blocks 390. After lower slips 350 set against casing 8, continued downward travel of mandrel assembly 12 closes bypass passage 1006 (FIG. 3C) by bringing seal 184 against packer saddle 270, after which upper slip assembly 130, biased by spring 160, contacts upper slip wedge collar 230 and forces it and upper bypass case downward, compressing packer element means 310 against casing 8 (FIGS. 3C and 3D) after which upper slips 138 contact and set against casing 8 (FIG. 3B). The downward travel of mandrel means assembly 12 results in ratchet dogs 330 engaging ratchet teeth 188 (FIG. 3D), locking gravel packer 10 in a set mode, spring 160 aiding in maintaining it therein. The packer is then pulled upward by the tubing string to test the ratchet engagement and upper slips, and the annulus 4 between the tubing string and casing 8 is pressured up to test the seal of packer element means 310 against casing 8.

Gravel packer 10 may then be released from gravel screen 702 via hydraulic releasing tool 500, if desired. To effect release the tubing string is picked up to pull a specified force, for example, 1000 pounds, against the set gravel packer 10. Tubing pressure is then applied through intake passage 1000 of gravel packer 10, past ball 482 which is biased downward against spring 484, through slip joint 700 to seat ball 672 against seat 668 in hydraulic release tool 500. Pressure is continued until shear pins 578 shear, and releasing mandrel 506 moves downward inside collet sleeve 504, releasing collets 588 from the outward bias of annular shoulder 658 at the bottom of releasing mandrel 506, and uncovering reversing ports 555, which results in a perceptable pressure drop at the surface. Tubing pressure is then relieved, and weight set down on the gravel packer 10. This will align crossover ports 40 with crossover apertures 60 in crossover assembly 20 (see FIG. 3A); pressure is then applied to annulus 4, which will establish reverse circulation if screen release has been effected, through crossover assembly 20, return passage 1002, through slip joint 700, into hydraulic releasing tool 500, out reversing ports 555 past reversing boot 566, up the annulus 5 below gravel packer 10, into gravel packer 10 through circulation passages 1004 past sleeve 446 and up to the surface through intake passage 1000 and the tubing string.

Alternatively, screen 702 may be released via pressuring annulus 4 after setting down to open crossover assembly 20, which will be transmitted to hydraulic releasing tool 500 through the reverse circulation path described in the preceding paragraph, forcing releasing mandrel 406 downward.

To gravel pack, a ball 455 is then dropped or circulated down the tubing string through intake passage 1000 to ball seat 454 in check valve assembly 444. Pressure is then applied to shear pins 462, which when sheared permit check valve assembly 444 to move downward, uncovering circulation passage 1004 (see FIGS. 3F and 3G) and establishing circulation through passage 1004, into annulus 5, down to gravel screen 702, through the apertures 706 therein, up washpipe 704, through hydraulic releasing tool 500 past unseated ball 672, through slip joint 700 and into return passage 1002, out of crossover assembly 20 through apertures 60 and ports 40, and up annulus 4 to the surface.

A fluid injection rate is then established by pulling up on the tubing string to close crossover assembly 20, and pressuring up the tubing until it is ascertained that fluid can be pumped into formation 6 at a desired rate and pressure. If not, the formation may have to be treated with acid to increase its permeability. If the injection rate is satisfactory, bypass passage 1006 can then be opened to "spot" the gravel-laden slurry to gravel packer 10 by pulling against the tubing string, applying pressure to annulus 4, rotating the tubing string to the right 12 to 16 turns to release ratchet dogs 330 from ratchet threads 188 and seal 184 from packer saddle 270, indicated by a relieving of the pressure in annulus 4. Slurry can then be spotted down to the gravel packer 10 without circulating formation fines or other debris into screen 702, as fluid below packer element means 310 will be displaced upward into annulus 4 via bypass passage 1006 by the slurry traveling down the tubing string and into intake passage 1000. After slurry spotting, the tubing string is set down to close bypass passage 1006 and open crossover assembly 20. The slurry is circulated out passage 1004 and down to screen 702, the gravel being deposited outside screen 702 adjacent formation 6, fluid returns being taken up washpipe 704.

After the gravel pack is placed, the tubing string is again pulled against the set gravel packer 10 to close crossover assembly 20, and the pack slurry is squeezed into the formation and against screen 702 through intake passage 1000, circulation passages 1004 and lower annulus 5. If desired, the operator may alternate between circulating and squeezing several times to place more gravel and ensure the integrity of the pack. It should be noted that gravel packer 10 permits squeezing without subjecting the casing above packer element means 310 to squeeze pressure, an important feature in wells with old or otherwise deteriorated casing.

If the screen 702 has not previously been released, the tubing string is set down, and annulus 4 is pressurized, this pressure being transmitted through crossover assembly 20 and down return passage 1002 to hydraulic releasing tool 500 as previously described, to move releasing mandrel 506 downward.

Excess slurry can be reverse circulated out of the tubing string gravel packer 10 and annulus 5, by circulating clean fluid down annulus 4 to crossover assembly 20, down return passage 1002, through slip joint 700, out reversing ports 555 past boot 566, up annulus 5, into circulation passages 1004, and up intake passage 1000 to the surface through the tubing string.

The gravel pack can be retested if desired in the circulate and/or squeeze mode, and repacking done if necessary, in the same manner described above.

The gravel packer 10 may then be unset, by pulling the tubing string against gravel packer 10, applying pressure to the annulus, rotating the tubing string to the right to release the ratchets and open bypass passage 1006 (indicated by relief of annulus pressure). The tubing string is then pulled up to retract upper slips 138, unset packing element means 310, unset lower slips 350 and return lugs 212 back into J-slots 412. Gravel packer 10, with slip joint 700, collet sleeve 504 and releasing mandrel 506 may then be removed from the wellbore, leaving tool case 502 and screen 702 in place with the gravel pack about the latter. Subsequently, a tubing seal assembly on production tubing may be stabbed into tool case 502 to produce formation 6 through screen 702.

Thus has been described a novel and unobvious apparatus for gravel packing a well. Of course, numerous additions, deletions and modifications to the preferred embodiment of the apparatus may be made without departing from the spirit and scope of the invention, as defined by the following claims.

We claim:

1. A retrievable gravel packer for placing a gravel pack in a wellbore about a gravel screen disposed therebelow across a producing formation comprising:

a gravel packer assembly;

a packer element disposed on the exterior of said assembly;

J-slot means in said assembly for selectively maintaining said packer element in an unset mode;

ratchet means in said assembly for releasably locking said packer element in a set mode;

an intake passage in said assembly for receiving fluid from a tubing string in said well bore above and secured to said gravel packer;

a return passage for receiving fluid from the interior of said gravel screen;

a circulation passage extending from the exterior of said gravel packer below said packer element to said intake passage;

closeable crossover means to receive fluid from said return passage and guide said received fluid from said return passage to the exterior of said assembly above said packer element;

first check valve means for preventing back flow to said intake passage from the interior of said gravel screen;

second check valve means adapted to selectively open said intake passage to said circulation passage in response to a positive pressure differential between the exterior of said gravel packer and said intake passage; and check valve release means for inactivating said second check valve means in response to a fluid pressure buildup in said intake passage thereabove.

2. The apparatus of claim 1, wherein said packer element is a compression-set packer element which is compressible through longitudinal tubing string movement to a set mode after said J-slot means is disengaged by longitudinal and rotational movement of said tubing string, said assembly further including packer compression means responsive to longitudinal tubing string movement.

3. The apparatus of claim 2, further including upper and lower slip means extendable to a set mode through longitudinal tubing string movement.

4. The apparatus of claim 1, wherein said crossover means is closeable through longitudinal movement of said tubing string.

5. A retrievable gravel packer for placing a gravel pack in a wellbore about a gravel screen disposed therebelow across a producing formation, comprising:

a mandrel assembly including first and second substantially concentric tubular mandrels extending from the upper end to the lower end thereof, closeable crossover means at the upper end of said assembly communicating the annulus between said first and second mandrels with said wellbore, and first ratchet means and first J-slot means associated with said second mandrel;

a housing assembly disposed about said mandrel assembly including a compressible packer element disposed on a packer saddle, a second ratchet means adapted to engage said first ratchet means when proximate thereto, and a second J-slot means adapted to engage and disengage said first J-slot means responsive to longitudinal and rotational movement of said tubing string; and a circulation assembly disposed at the lower end of said mandrel assembly including a circulation housing having circulation ports in the wall thereof and secured to said second mandrel, a circulation mandrel secured to said first mandrel and disposed within said circulation housing, said circulation mandrel having lateral circulation channels therein extending from said circulation ports to the interior of said circulation mandrel, the bore thereof being in communication with the bore of said first mandrel, first check valve means below said circulation mandrel in communication with the bore thereof comprising check ball means upwardly biased against a ball seat, second check valve means disposed within said circulation mandrel including an elastomeric sleeve extending across the inner ends of said circulation channels and a tubular valve seat body therebelow shearably secured to said circulation mandrel.

6. The apparatus of claim 5, wherein said gravel packer further includes a closeable bypass passage extending between said mandrel assembly and said housing assembly from above said packer element to below said packer element.

7. The apparatus of claim 6, wherein said bypass passage is closeable through relative longitudinal movement of said mandrel and housing assemblies.

8. The apparatus of claim 5, further including upper and lower slip means expandable to a set mode through relative longitudinal movement between said mandrel and housing assemblies.

9. The apparatus of claim 8, wherein said upper slip means comprises downwardly-biased upper slips disposed on said mandrel assembly expandable through contact with slip wedge means on said housing assembly above said packer element and said lower slip means comprises lower slips disposed on said mandrel assembly expandable through contact with slip wedge means on said housing assembly below said packer element.

10. The apparatus of claim 9, further including drag block means disposed on said mandrel assembly.

11. The apparatus of claim 5, wherein said first J-slot means comprises at least one J-slot lug radially extending from said mandrel assembly into a J-slot associated with said housing assembly, said J-slot comprising said second J-slot means.

12. The apparatus of claim 5, wherein said first ratchet means comprises a left-hand ratchet thread on the exterior of said mandrel assembly, and said second ratchet means comprises a plurality of radially inwardly biased ratchet dogs associated with said housing assembly and having left-hand threads on the insides thereof engageable with said mandrel assembly threads.

13. The apparatus of claim 5, further including a ball disposed on said valve seat body in said circulation mandrel.

14. The apparatus of claim 5, wherein said closeable crossover means comprises a crossover housing having a crossover sleeve slidably disposed therein, said crossover housing being secured to said tubing string, and said crossover sleeve being secured to said mandrel assembly, said crossover means being closeable through longitudinal misalignment of apertures in said sleeve with ports in said housing, said misalignment being effected through longitudinal movement of said tubing string.

15. The apparatus of claim 14, wherein said first J-slot means comprises at least one J-slot lug radially extending from said mandrel assembly into a J-slot associated with said housing assembly, said J-slot comprising said second J-slot means.

16. The apparatus of claim 15, wherein said first ratchet means comprises a left-hand ratchet thread on the exterior of said mandrel assembly, and said second ratchet means comprises a plurality of radially inwardly biased ratchet dogs associated with said housing assembly and having left-hand threads on the insides thereof engageable with said mandrel assembly threads.

17. The apparatus of claim 16, wherein said gravel packer further includes a closeable bypass passage extending between said mandrel assembly and said housing assembly from above said packer element to below said packer element.

18. The apparatus of claim 17, wherein said bypass passage is closeable through relative longitudinal movement of said mandrel and housing assemblies.

19. The apparatus of claim 18, further including upper and lower slip means expandable to a set mode through relative longitudinal movement between said mandrel and housing assemblies.

20. The apparatus of claim 19, wherein said upper slip means comprises downwardly-biased upper slips disposed on said mandrel assembly expandable through contact with slip wedge means on said housing assembly above said packer element and said lower slip means comprises lower slips disposed on said mandrel assembly expandable through contact with slip wedge means on said housing assembly below said packer element.

* * * * *

UNITED STATES PATENT AND TRADEMARK OFFICE

CERTIFICATE OF CORRECTION

PATENT NO. : 4,638,859

DATED : January 27, 1987

INVENTOR(S) : Gary D. Zunkel and Michael L. Bolin

It is certified that error appears in the above-identified patent and that said Letters Patent is hereby corrected as shown below:

In column 6, line 46, delete the number [756,040] and insert therefor --756,892--.

Signed and Sealed this

Twenty-first Day of April, 1987

*Attest:*

DONALD J. QUIGG

*Attesting Officer*

*Commissioner of Patents and Trademarks*